US005575221A

United States Patent [19]

Biegel et al.

[11] Patent Number: 5,575,221

[45] Date of Patent: Nov. 19, 1996

[54] TRUCK MOUNTED BRAKE SYSTEM

[75] Inventors: Robert A. Biegel, South Holland, Ill.; Peter R. Manyek, Highland, Ind.

[73] Assignee: Thrall Car Manufacturing Company, Chicago Heights, Ill.

[21] Appl. No.: 377,123

[22] Filed: Jan. 23, 1995

[51] Int. Cl.[6] ..... B61F 5/00

[52] U.S. Cl. ..... 105/226; 105/157.1

[58] Field of Search ..... 105/157.1, 226, 105/227, 228, 229, 230; 188/153, 206 R, 207, 219.1

[56] References Cited

U.S. PATENT DOCUMENTS

| | | | |
|---|---|---|---|
| 2,170,123 | 8/1939 | Busch | 188/212 |
| 3,203,855 | 3/1962 | Shafer | 105/226 |
| 4,729,325 | 3/1988 | Henkel | 105/226 |
| 4,793,446 | 12/1988 | Hart et al. | 188/53 |
| 4,838,174 | 6/1989 | Moehling | 105/226 |
| 5,000,298 | 3/1991 | Jackson et al. | 188/219.1 |
| 5,221,015 | 6/1993 | Mautino et al. | 213/67 R |
| 5,259,485 | 11/1993 | Jackson | 188/198 |
| 5,364,062 | 11/1994 | Doyle, Jr. et al. | 188/153 R |

OTHER PUBLICATIONS

"Analysis and Design of Flight Vehicle Structures"; Bruhn et al; Jacobs Publishing Inc,; pp. D3.7–D3.10. 1973.

"Aircraft Structures: Second Edition", Peery et al; McGraw–Hill Book Co.; pp. 251–260 1982.

*Primary Examiner*—S. Joseph Morano

*Attorney, Agent, or Firm*—Fitch, Even, Tabin & Flannery

[57] ABSTRACT

A truck mounted brake system comprising a brake cylinder mounted on a truck bolster, having a cylinder rod extending through the bolster, wherein a series of elongated slots are provided in the second sidewall and the intermediate webs of the bolster to facilitate access to mounting bolts for the brake cylinder. The slots are dimensioned to avoid unnecessary weakening of the bolster. In the preferred embodiment, the brake cylinder is positioned so that the pivot point at which the cylinder rod joins the brake lever is substantially coaxial with the brake cylinder bushing when the cylinder rod is in its extended, loaded position. Interior and exterior surfaces of the bolster sidewall which the brake cylinder and its associated fasteners engage are preferably substantially planar to avoid loosening of the fasteners over time due to surface irregularities.

11 Claims, 3 Drawing Sheets

TRUCK MOUNTED BRAKE SYSTEM

BACKGROUND OF THE INVENTION

The invention relates generally to brake systems for railroad cars, and more particularly to improvements in a truck mounted brake system wherein a brake cylinder is mounted on a truck bolster.

In brake systems of the type to which the present invention relates, the brake cylinder is attached to a first sidewall of the bolster by two bolts or studs extending through holes in the bolster. A cylinder rod extends through the bolster and is connected to a lever on the opposite side of the bolster.

While braking systems of this type have proven satisfactory in operation, the installation of the brake cylinder has generally been a difficult and time consuming task, both in the context of new installations and in the context of replacing the brake cylinder after a period of use. Originally, brake cylinders of this type were manufactured with threaded bores to receive bolts extending through holes from the bolster interior. It was necessary for the brake cylinder, which weighs about 30 pounds, to be supported in its proper position, with its threaded bores aligned with the bolt holes in the bolster, while the bolts were inserted into the threaded bolt holes in the brake cylinder and tightened. Tightening of the bolts required maneuvering a wrench in a confined and difficult location within the bolster interior.

In an effort to alleviate the difficulty in installation, some brake cylinders were manufactured with studs pre-installed thereon for insertion through the bolster bolt holes, thus only requiring that nuts be placed on the threaded studs after their insertion into the bolster. However, placement of the nuts on the threaded studs and tightening of the nuts has still required maneuvering a wrench in an awkward location, and has still been a difficult and time consuming task. Thus, installation of the brake cylinder has remained a difficult and arduous task that may require two workers.

Because the bolster is a heavy iron or steel casting which must be capable of supporting loads on the order of 100 tons, its geometry cannot be altered to facilitate access to the bolt heads or nuts without consideration of possibly detrimental effects on its load capacity, durability, and wear life. Any alteration of the bolster or brake system configuration must also take into account clearances needed for pivoting of the truck and for avoidance of interference with the placement and operation of other equipment.

In the past, efforts to facilitate access to the bolt heads or nuts involved use of specially-designed torque wrenches with a plurality of joints and specially-ground custom sockets. However, it has been found to be difficult or impossible to accurately measure torque with these devices. It is important that the bolts or nuts be tightened to an appropriate torque, because otherwise the bolts or nuts may loosen over time, after being subjected to the dynamic loads and vibrations associated with use of the railroad cars and their braking systems for an extended period. Thus, the difficulty in measuring torque accurately has been problematic.

Even where the nuts or bolts are properly torqued, they may loosen over time. It is an object of the invention to facilitate accurate measurement of bolt or nut torque in this context and to address the problem of loosening of the subject bolts and nuts during use.

A further problem addressed by the invention relates to increasing the life of the brake cylinders. The cylinder rod is typically guided by a bushing at the location where the piston rod protrudes from the cylinder. In the past, the geometry of the brake system was such that the pivot point at which the brake cylinder rod engaged the brake lever was aligned coaxially with the axis of the bushing when the piston rod was in its retracted position, in which the brakes were not applied. When the brake cylinder rod is shifted to its extended position in this type of prior art system, the pivot point moves arcuately and accordingly moves off axis by about ¼ in., which tends to misalign the piston rod slightly and leads to wear on the bushing, particularly because when the piston rod is extended, the brakes are applied, and accordingly the piston rod is under load.

It is a general object of the invention to provide an improved truck mounted braking system to facilitate installation and to increase reliability and useful life. Further objects of the invention will become apparent from the detailed description set forth below and the accompanying drawings.

SUMMARY OF THE INVENTION

The invention provides a novel and improved truck mounted brake system and an improved method for installing a brake cylinder. The brake system is mounted on a railroad truck comprising a bolster having a first sidewall with a pair of holes therein, a second sidewall, and at least one intermediate web. The braking system comprises a brake cylinder mounted on the first sidewall, a cylinder rod extending through the sidewalls and the web, and at least two fasteners extending through the holes in the first sidewall. At its distal end, the cylinder rod is connected to a lever which is connected to a linkage that shifts the brake shoes from a released position to a braking position upon actuation of the cylinder rod from a retracted position to an extended position.

In accordance with the invention, there is provided a series of elongated slots in the second sidewall and the intermediate webs of the bolster to provide clearance for insertion of a wrench on either side of the cylinder rod so that the fasteners which secure the brake cylinder onto the bolster may be accessed and viewed by a direct linear path from the exterior of the bolster adjacent the second sidewall.

In accordance with a further aspect of the invention, the brake cylinder is positioned so that the pivot point at which the cylinder rod joins the lever lies substantially on the axis of the brake cylinder bushing when the cylinder rod is in its extended, loaded position, thereby enabling the cylinder rod to be substantially centered and coaxial with the bushing when in its extended position and under load.

In accordance with a further aspect of the invention, it has been determined that slag or other surface irregularities on the bolster castings may cause loosening of the nuts or bolts over time, in that the bolt head or nut may engage a particle of slag or other surface irregularity, which may be eroded, displaced, or crushed over time during operation of the railroad car and the braking system, resulting in a loosening of the nut or bolt. It should be appreciated that, during operation of the braking system, the nuts are subjected to tensile stresses opposing the compressive load on the brake cylinder rod, which provides the force to urge the brake shoes against the wheels. The repeated loading of the bolts or studs by such forces as brakes are applied and released contributes to the problem. To address the problem, the exterior surface of the first sidewall of the bolster against which the brake cylinder abuts is substantially planar, and the interior surface of the first sidewall is also substantially planar from the edges of the holes to a radius of about ¾ in.

from the centers of the holes, to avoid loosening of the fasteners over time due to the presence of surface irregularities which may normally be present in heavy steel or iron castings.

Additional features of the invention will become apparent from the detailed description set forth below, considered in conjunction with the accompanying drawings.

DETAILED DESCRIPTION OF THE PREFERRED EMBODIMENT

Figure 3:
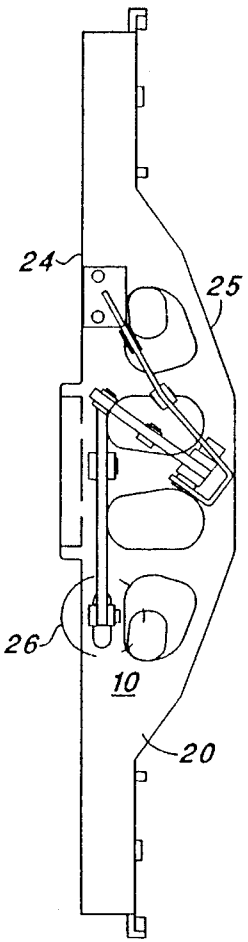
FIG. 3 is an end view of the truck of FIG. 1, taken from the right-hand side of FIG. 1.
Figure 1:
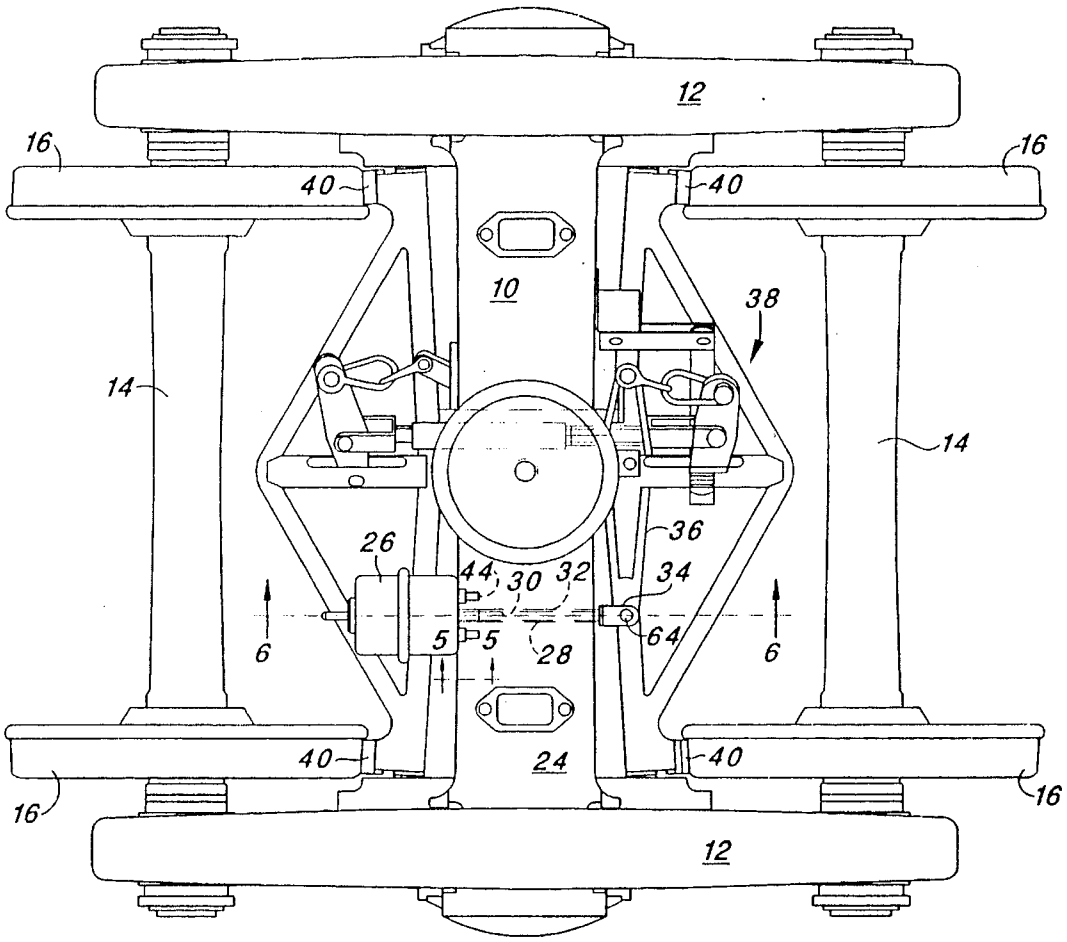
FIG. 1 is a plan view of a railroad truck.
Figure 2:
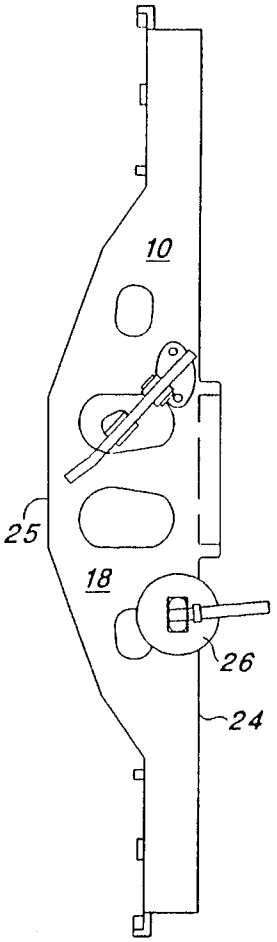
FIG. 2 is an end view of the truck of FIG. 1 taken from the left-hand side of FIG. 1.
Figure 4:
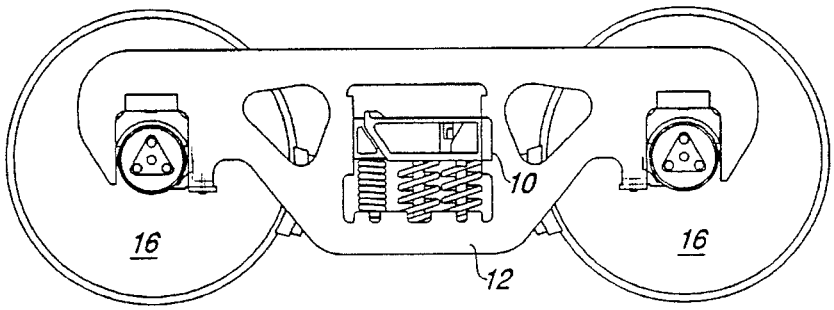
FIG. 4 is a side elevational view of the truck of FIG. 1.
Figure 5:
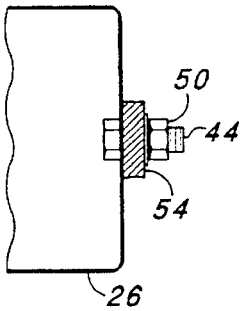
FIG. 5 is an enlarged fragmentary sectional elevational view taken substantially along line 5—5 in FIG. 1.
Figure 6:
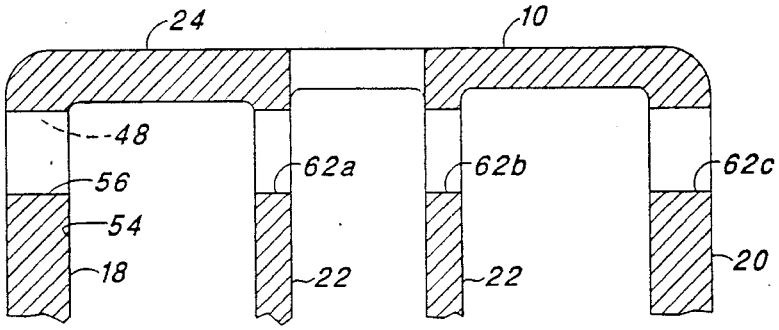
FIG. 6 is an enlarged fragmentary sectional elevational view of the bolster of FIG. 1, taken substantially along line 6—6 in FIG. 1.

The invention is generally embodied in a truck mounted brake system for a railway car. The truck generally comprises a bolster 10 extending transversely between a pair of side frames 12 which engage the respective ends of a pair of wheel assemblies each comprising an axle 14 and a pair of wheels 16 which are rotatably engaged by the side frames.

The bolster generally comprises a first sidewall 18, a second sidewall 20, top and bottom walls 24 and 25 which extend from the first sidewall to the second sidewall, and a pair of intermediate webs 22 extending vertically from the top wall 24 to the bottom wall 25. The bolster is preferably a steel or iron casting having sufficient strength to support a load on the order of about 70 tons to about 125 tons, depending upon the particular truck capacity.

The brake system generally comprises a pneumatic brake cylinder 26 having a cylinder rod 28 extending therefrom which is reciprocable between a retracted position corresponding to a released position of the truck brake, and an extended position corresponding to an applied position of the truck brake. The cylinder rod 28 is a two-piece rod comprising a piston rod 30 which extends outward from the interior of the cylinder, and a push rod 35 with a hollow section 32 which fits over the end of the piston rod 30 and has a pivot fitting 34 thereon.

The cylinder rod is pivotably connected to a lever 36 which acts through a linkage 38 to apply braking force, and more specifically to apply pressure to urge the brake shoes 40 against the wheels when the cylinder rod is shifted to its extended position by pneumatic pressure within the cylinder. A bushing 42 engages the cylinder rod to guide it through the orifice through which it exits the cylinder.

Figure 8:
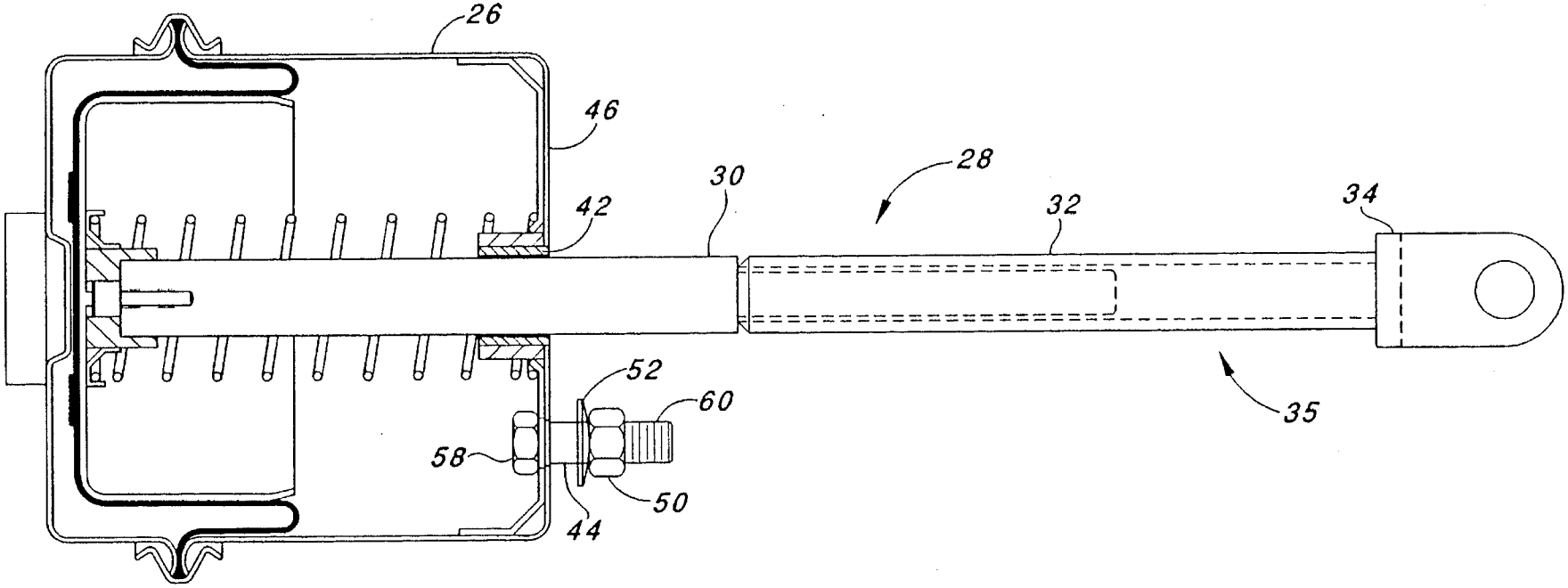
FIG. 8 is an enlarged sectional plan view of the brake cylinder, with one of the mounting studs shown.

The brake cylinder 26 is attached to the first sidewall 18 of the bolster in the illustrated embodiment by a pair of studs 44, one of which is shown in detail in FIG. 8, which extends through an end wall 46 of the cylinder and through bolt holes 48 in the first sidewall 18 of the bolster, and which have nuts 50 threadedly engaging their distal ends and tightened thereon, with suitable washers 52 disposed between the nuts and the interior surface 54 of the bolster sidewall. The bolt holes 48 are disposed on opposite sides of a larger diameter hole 56 for the cylinder rod 28. As may be seen in FIG. 8, each of the studs 44 may comprise a bolt having its head 58 disposed on the interior of the brake cylinder and secured in place against the end wall of the brake cylinder, with its shaft 60 protruding through the end wall.

Figure 7:
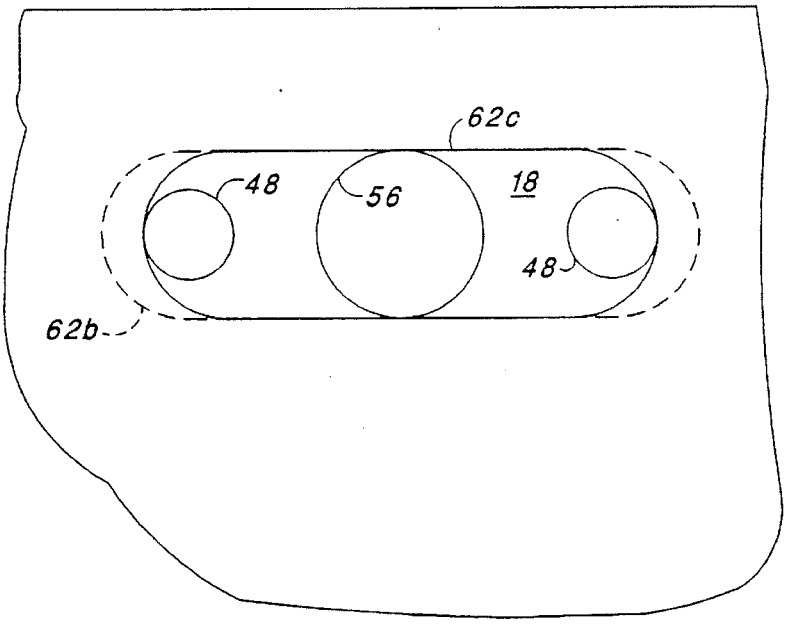
FIG. 7 is an enlarged fragmentary end elevational view of the bolster.

In accordance with the invention, there is provided a series of elongated slots 62*a*, 62*b*, and 62*c* which are aligned with one another and formed in the second sidewall 20 and the intermediate webs 22 to permit direct linear viewing of, and access to, the bolt holes and the bolt heads or nuts which must be tightened to secure the cylinder in place. Each of the elongated slots 62*a–c* is centered on the cylinder rod 28 and has semicircular ends. The slots are dimensioned to provide clearance for insertion of a wrench on either side of the cylinder rod, but preferably have their dimensions limited to avoid unnecessarily weakening the bolster. To this end, the vertical dimension of each slot is only slightly greater than the dimension of the cylinder rod sleeve 32, and the slot 62*c* in the second sidewall 20, which is heavier and thicker than the webs 22, is shorter than the slots 62*a* and 62*b* in the webs 22. The slots in the interior webs 22 are preferably dimensioned to provide clearance for a ½ in. drive socket centered on each bolt hole, and to this end each of the inner web slots 62*a* and 62*b* has its ends defined as a radius of about 29/32 in. about the axis of each bolt hole. The slot 62*c* in the second sidewall 20 has its ends similarly radiused, but positioned inward with respect to the interior slots 62*a* and 62*b* so that its outer edges are tangent to cylinders defined by the bolt holes so as to appear tangent to the outer edges of the bolt holes 48, as viewed in elevation, as shown in FIG. 7.

In the preferred embodiment, each of the slots 62*a–c* has a vertical dimension of about 1 13/16 in., with slot 62*a* having a length of about 5 9/16 in. and interior slots 62*b* and 62*c* having a length of at least 5 13/16 in.

In accordance with a further aspect of the invention, the brake cylinder 26 is positioned relative to the pivot point 64 at which the cylinder rod 28 pivots relative to the brake lever 36 so that the pivot point 64 lies substantially on the axis of the bushing 42 when the cylinder rod is in its extended position, thereby enabling the cylinder rod 28 to be substantially centered and coaxial with the bushing 42 when in its extended position and under load.

In accordance with a further aspect of the invention, the bolster 10, which is an iron or steel casting, has the interior surface 54 of the first sidewall 18 substantially planar within tolerances of about 0.032 in. from the edges of the bolt holes to a radius of about ¾ in. from the centers of the bolt holes. The exterior surface against which the cylinder abuts is also substantially planar within the same tolerance. The desired degree of planarity may be ensured by examining the subject surfaces after the casting has been formed, and abrading the surface if necessary to remove slag particles or other surface irregularities. This avoids loosening of the nuts 50 over time to slag particles or other irregularities on the bolster sidewall. The nuts 50 are preferably tightened to a torque of about 140 ft.-lbs. Bowed Belleville washers 52 may be provided beneath the nuts.

From the foregoing it should be appreciated that the invention provides a novel and improved braking system which eliminates much of the difficulty previously associated with installation of braking systems of this type, and which also addresses the problems of loosening of the bolts or nuts which secure the brake cylinder in place, and wear of the brake cylinder bushing. The invention is further described and more particularly pointed out in the following claims.

What is claimed is:

1. In a railroad truck comprising a pair of side frames and a bolster extending between said side frames, said bolster having a first sidewall with a pair of horizontally spaced holes therein, a second sidewall, and two intermediate webs, and a braking system comprising a brake cylinder mounted on said first sidewall, a cylinder rod extending through said sidewalls and said webs, and at least two fasteners extending through said holes in said first sidewall, the improvement comprising:

a series of aligned, horizontally elongated slots formed in the second sidewall and said intermediate webs, each of said elongated slots being centered on the cylinder rod and being dimensioned to permit direct linear viewing of, and access to, both of said holes, each said slot providing clearance for insertion of a wrench on either side of said cylinder rod.

2. The improvement of claim 1 wherein said series of aligned, elongated slots comprises an outer slot in said second sidewall and inner slots in said intermediate web, and wherein said outer wall has a greater thickness than said intermediate webs, and wherein said outer slot is shorter than said intermediate slots, said outer slot having its end substantially tangent to cylinders defined by said bolt holes, and being dimensioned so as to include said cylinders within its length, and said intermediate slots having their ends configured to define a radius of curvature of about one-half the vertical dimension of said intermediate slots, centered on the axes of said bolt holes.

3. The improvement of claim 2 wherein said brake cylinder further comprises a bushing engaging the exterior of said cylinder rod, said cylinder rod being axially displaceable between a retracted position in which brakes are released, and an extended position in which brakes are applied, and said braking system further comprising a lever connected to said cylinder rod at a pivot point which traverses an arc as the brake cylinder rod is axially displaced;

said brake cylinder being positioned relative to said pivot point so that said pivot point lies substantially on the axis of said bushing when said cylinder rod is in its extended position, thereby enabling said cylinder rod to be substantially centered and coaxial with said bushing when in its extended position and under load.

4. The improvement of claim 3 wherein said bolster is a metal casting and wherein said first sidewall has an interior surface which is substantially planar within 0.032 in. tolerances over an area extending from the edges of the holes to a radius of about ¾ in. from the centers of the holes, and has an exterior surface against which said cylinder abuts which is substantially planar within a 0.032 in. tolerance.

5. A method of installing a brake cylinder having a reciprocal brake piston rod extending therefrom on a railroad truck bolster comprising:

inserting a pair of studs on the brake cylinder through a pair of bolt holes in a first sidewall of the bolster;

inserting the brake piston rod through a cylinder rod hole in said first sidewall, said cylinder rod hole being located between said bolt holes;

inserting the brake piston rod through a series of aligned elongated slots in two intermediate webs of the bolster and the second sidewall of the bolster to provide a clearance therebetween;

placing a nut on each of the studs;

inserting a torque wrench through the clearance in the series of elongated slots in the second sidewall and intermediate webs and applying a predetermined torque to one of said nuts to tighten said nut; and inserting a torque wrench through the clearance in the series of elongated slots in the second sidewall and intermediate webs and applying a predetermined torque to the other of said nuts.

6. A method in accordance with claim 5 further comprising connecting the brake cylinder rod to a lever on the truck at a pivot point on the lever which traverses an arc as the brake cylinder rod is displaced axially from a retracted position in which brakes are not applied to an extended position in which brakes are applied;

positioning said brake cylinder relative to said lever so that said pivot point is substantially aligned with the axis of a brake cylinder bushing when the brake cylinder rod is in its extended position.

7. A method of installing a brake cylinder having a reciprocal brake piston rod extending therefrom on a railroad truck bolster comprising:

inserting a pair of fasteners-through a pair of bolt holes in a first sidewall of the bolster;

inserting the brake piston rod through a cylinder rod hole in said first sidewall, said cylinder rod hole being located between said bolt holes;

inserting the brake piston rod through a series of aligned elongated slots in at least one intermediate web of the bolster and the second sidewall of the bolster to provide a clearance therebetween;

inserting a wrench through the clearance in the series of elongated slots in the second sidewall and at least one intermediate web and applying a torque to tighten one of said fasteners; and inserting a wrench through the clearance in the series of elongated slots in the second sidewall and intermediate webs and applying a torque to tighten the other of said fasteners.

8. A method in accordance with claim 7 further comprising connecting the brake cylinder rod to a lever on the truck bolster at a pivot point on the lever which traverses an arc as the brake cylinder rod is displaced axially from a retracted position in which brakes are not applied to an extended position in which brakes are applied;

positioning said brake cylinder relative to said lever so that said pivot point is substantially aligned with the axis of a brake cylinder bushing when the brake cylinder rod is in its extended position.

9. In combination, a railroad truck comprising a pair of side frames, a bolster extending between said side frames, and a braking system, said bolster having a first sidewall with a pair of horizontally spaced holes therein, a second sidewall, and at least one intermediate web, said braking system comprising a brake cylinder mounted on said first sidewall, a cylinder rod extending through said sidewalls and said at least one web, and at least two fasteners extending through said holes in said first sidewall;

wherein said bolster has a series of slots formed in the second sidewall and said at least one intermediate web, said slots being substantially aligned and providing a clearance with said rod to permit direct linear viewing of, and access to, both of said holes, to facilitate installation of said brake cylinder on said bolster by way of said clearance.

10. A combination in accordance with claim 9 wherein said at least one intermediate web comprises two intermediate webs.

11. A combination in accordance with claim 10 wherein said series of slots comprises an outer slot in said second sidewall and at least one inner slot in said at least one intermediate web, and wherein said outer slot is shorter than said at least one inner slot.

* * * * *